US006939071B1

(12) United States Patent
Breidenbach et al.

(10) Patent No.: US 6,939,071 B1
(45) Date of Patent: Sep. 6, 2005

(54) ROLL-ON APPLICATOR

(75) Inventors: Diane C. Breidenbach; Laurence W. Mille, both of Smithtown, NY (US)

(73) Assignee: Fragrance Systems International, Hauppauge, NY (US)

( * ) Notice: Subject to any disclaimer, the term of this patent is extended or adjusted under 35 U.S.C. 154(b) by 0 days.

(21) Appl. No.: 09/515,955

(22) Filed: Feb. 29, 2000

(51) Int. Cl.[7] ..... B43K 7/00; B43K 7/03
(52) U.S. Cl. ..... 401/209; 401/215
(58) Field of Search ..... 401/208, 209, 401/215

(56) References Cited

U.S. PATENT DOCUMENTS 2,763,882 A * 9/1956 Planka ..... 401/209
3,186,416 A * 6/1965 Kolts ..... 401/209
4,940,350 A * 7/1990 Kim ..... 401/209

FOREIGN PATENT DOCUMENTS

DE 818317 * 12/1951 ..... 401/215

* cited by examiner

*Primary Examiner*—Gregory L. Huson
*Assistant Examiner*—Tuan Nguyen
(74) *Attorney, Agent, or Firm*—Thomas A. O'Rourke; Wyatt, Gerber & O'Rourke

(57) ABSTRACT

A container for applying a lip treatment material to a user is described. The lip treatment material may have a chromatic or nonchromatic color or be a dark gray. The container has a base, an outer surface, an inner surface and a top surface. The top surface has at least one orifice therein. The container has a rotatable ball mounted at the orifice for applying the lip treatment material from the container to the lips of the user. The rotatable ball has a color selected from the group consisting of chromatic and nonchromatic colors, blacks or dark grays.

25 Claims, 2 Drawing Sheets

ROLL-ON APPLICATOR

FIELD OF THE INVENTION

The present invention relates to an improved roll-on applicator particularly for applying a lip covering material. The present invention also has particular applicability where a second lip material is being applied over a first lip covering material. The roll-on applicator according to the present invention prevents the color of the lip covering material from appearing on the roller ball of the roll on applicator.

BACKGROUND OF THE INVENTION

Roll-on applicators are well known in the art. Usually, these applicators are containers comprising a hollow body for liquids or semi liquids, a ball and a retaining support means for said ball. These roll-on applicators generally allow a person to apply a liquid or semi liquid material from the inside of the hollow body to a selected surface. In many applications the material applied is colored or tinted. When this colored material is applied by the roll-on applicator some of the material being applied remains on the ball's outer surface giving the impression to the user that the applicator is soiled. This problem is particularly acute where a second material is being applied over a first material such as where a clear or relatively clear lip gloss is being applied over a colored lip covering. In such situations, portions of the first lip covering material has a tendency to transfer to the surface of the roll-on applicator It is an object of the present invention to provide a container with a roll-on applicating means which prevents the appearance of soiling on the roll-on applicator ball from colored product being dispensed by the applicator.

It is also an object of the present invention to provide a roll-on applicator that prevents a first colored lip covering presently on the lips from discoloring the roll-on applicator ball of another cosmetic product.

SUMMARY OF THE INVENTION

The present invention is directed to an improved application means for applying lip coverings such as lip gloss, various moisturizers, salves, balms, unguents, emoluments and other treatments. The present application has particular application to applying these various materials to lips by means of a roll-on applicator. In particular the invention is advantageous in applications where the wearers already have a lipstick or other lip coloring material present. For example, although many consumers apply lipstick or other colorants to the lips, from time to time there is a need to enhance the look that a traditional lip covering provides. There is available on the market a variety of lip glosses that are applied over a pre-existing lip color. These lip glosses enhance the look of the lips by providing the lips with a high sheen or gloss. Many people believe that the beauty of the lips is enhanced when the lips are perceived as being moistened. Lip glosses provide the lips with this moistened look.

Lip glosses can be in the form of a stick which would be applied by an applicator in the same manner as traditional lipsticks are. Another means of applying a lip gloss is from a receptacle by the wearer's fingertips or by a brush. In addition, there are a number of other different types of applicators designed for this product. One common type applicator that is currently available on the market is a container that comprised a reservoir for the lip gloss. The container can be any number of shapes and has an orifice for dispensing the product. Covering the orifice is a rotating ball for applying the lip product particularly a lip gloss to the wearer's lips. As the ball rotates, the lip material is applied to the outer surface of the ball whereby the material is transferred from the interior of the container to the outer by he rotating ball. Other types of containers typically include a brush or an applicator surface that provides a means for retaining the material to be applied as it is being transferred from the container to the lips.

One of the problems in applying lip glosses and other products over a pre existing lip stick or other applied color is the problem of transferral, whereby some of the colored material that is currently on the lips transfers to the applicator surface creating an unsightly residue. This unsightly residue creates the impression that the applicator surface is soiled. In addition, if the wearer uses different shades of the same general color there can be multicolored streaks on the applicator surface. This problem is particularly acute in the present rotating ball type applicators which are a white or clear plastic or glass ball.

The problem of transferral of lip color from the lips to the rotating ball of the applicator is solved by the present invention whereby the rotating ball is not the traditional clear or white glass or plastic ball. Rather, in the present invention the ball is selected from a color preferably a color of the material being applied where there is no lip covering presently on the lips. Alternatively, where there is a lip coloring already present on the lips, the color of the ball is selected from one that is related to the color of the lip coloring that is presently on the lips. Although it is preferable that the ball be the same color as the lip material being dispensed or already on the lips, it has been found that the ball color can be within a range of color and still mask the coloring of the lip covering material Many consumers have a particular range of lip colors that they use on a regular basis. Depending on the complexion, eye color and the color of the attire being worn the consumer makes a color selection for her lips. While lip colors may change from time to time it is not unusual for the colors to be similar i.e., in the same general family. When a lip gloss or other lip product is purchased to apply to the lips the consumer can select an applicator ball that is similar to the color of the lip stick of the user. The use of the colored ball masks the transferral of the lip product that is currently on the lips to the ball surface.

DETAILED DESCRIPTION OF THE INVENTION

Figure 1:
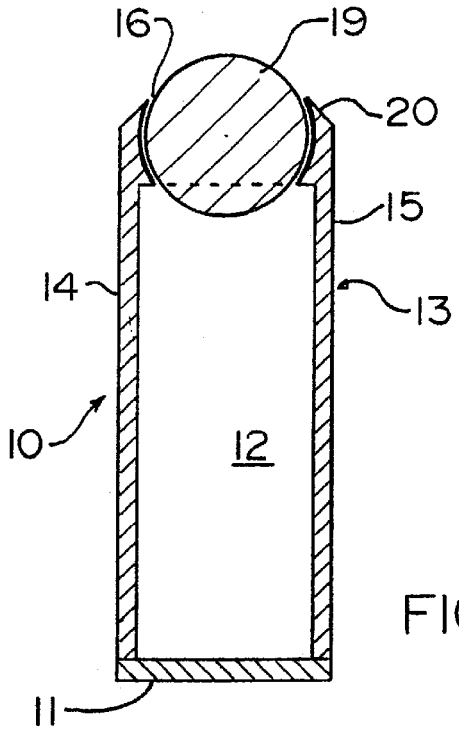
FIG. 1 is an example of a roll-on applicator or container for applying lip covering material such as lip stick, lip gloss or other products.
Figure 2:
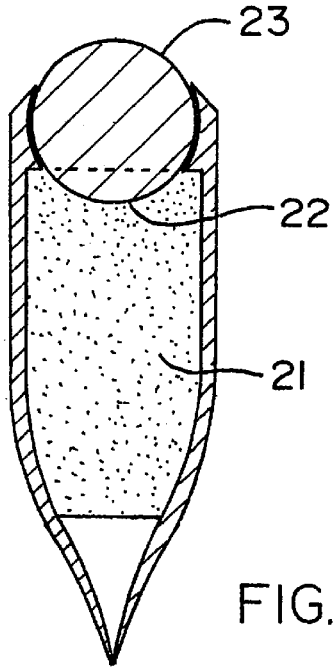
FIG. 2 shows another type of roll-on applicator for applying lip covering material.
Figure 3:
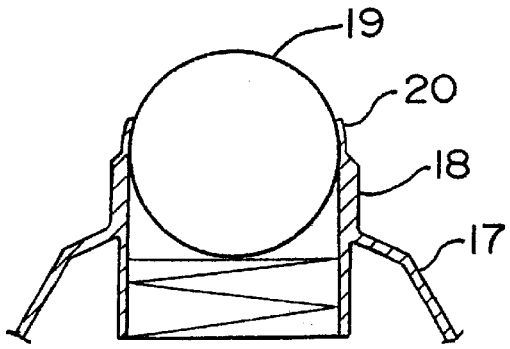
FIG. 3 shows an enlarged view of a roller ball in a roll on applicator where the ball is forced into position against the applicator orifice by a spring.
Figure 4:
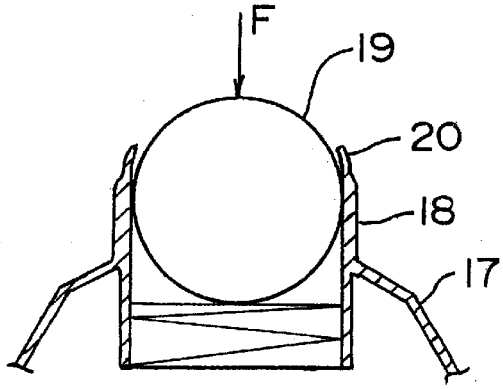
FIG. 4 shows the roller ball of FIG. 3 where a force F has been applied to the outer surface of the roller ball forcing the ball away from the applicator orifice to permit application of product from the interior of the applicator to the consumer.
Figure 6:
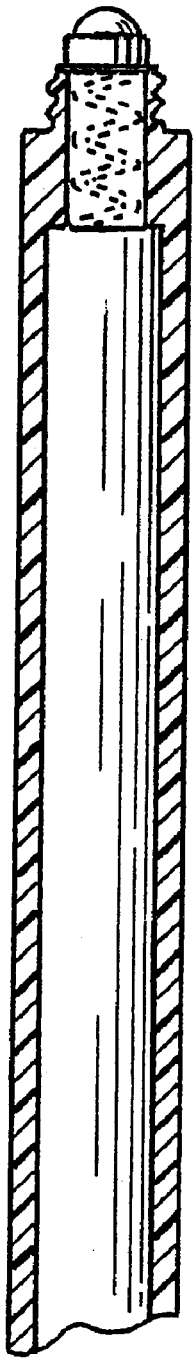
FIG. 6 shows an applicator with the insert in place.
Figure 5:
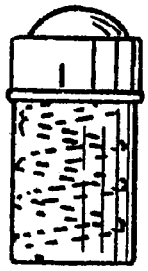
FIG. 5 shows an insert that contains the roller ball which may be inserted into the opened end of the applicator.

FIG. 1 shows an example of the type of containers for use with the present invention. The container may be of any shape or size. FIG. 1 is a generic container 10 having a base 11, a front surface 12, a rear surface 13, a pair of sidewalls 14 and 15 and an orifice 16 at the top. The walls of a container may taper to form a breast 17 and a neck 18. The ball 19 is rotatably mounted in the container by any suitable means and may be retained in place by a tip 20 of the applicator or a separate insert. When the container is tilted toward the lips of the user, the product 21 within the container contacts the ball surface 22 on the interior of the container. When the ball is rotated the product passes between the ball surface and the collar and is available for application to the user on the surface 23 of the ball outside the container.

When the ball is made of a glass or plastic material, the ball can be any chromatic or nonchromatic color. Chromatic colors are the colors of the visible spectrum. Nonchromatic colors include the browns, magentas and pinks. Excluded from the present invention are the achromatic colors of the white-light gray sequence. For purposes of this application the color white may also include clear without any pigment or color. When the ball is comprised of a metallic material on at least its exterior surface the ball may be any chromatic or nonchromatic color except a silver or gold. Black is a color that is included within the invention as it will mask virtually any color.

The term color is the perceptual result of light incident upon the retina, in the visible region of the spectrum having wavelengths in the range of about 350 mn to about 750 mn although the more typical range is 400 nm to 700 nm. The Table below shows the typical range of the visible spectrum:

| Color | Wavelength (nm) | Frequency (100,000,000,000,000 Hz) | Energy (EV) |
|---|---|---|---|
| Red (limit) | 700 | 4.29 | 1.77 |
| Red | 650 | 4.62 | 1.91 |
| Orange | 600 | 5.00 | 2.06 |
| Yellow | 580 | 5.16 | 2.14 |
| Green | 550 | 5.45 | 2.25 |
| Cyan | 500 | 5.99 | 2.48 |
| Blue | 450 | 6.66 | 2.75 |
| Violet (limit) | 400 | 7.50 | 3.10 |

The color of the ball of the present invention may be measured by either the absorption of light by the surface of the ball or by the reflection of light off its surface. For example, in one theory concerning color, a substance that appears yellow does so because it absorbs most strongly in the blue part of the spectrum and scatters most strongly in the red and green parts of the spectrum. It is also not unusual for a pigment to scatter light most efficiently in one region of the spectrum while having its main absorption band in another. Putting it a different way, if light having a wavelength of about 550 nm is reflected off of the surface of the ball the color of the ball to the eye is green. Alternatively, if light in the range of about 400–549 nm and about 551–700 nm is absorbed by the surface of the ball the ball will also appear green.

Bear in mind that the spectrum of light is continuous and does not have defined breaks for the colors. The wavelengths set out above are commonly ascribed to the particular colors but it will be recognized by those skilled in the art that one persons perception of color may differ from another's. Accordingly, what one person perceives as for example blue may not have the same exact wave length as the blue perceived by someone else. However, the blues seen by each party should be in generally the same region of the spectrum.

Typically, a consumer applies a lip covering material such as lipstick to her lips. This may be applied by any suitable fashion such as by a traditional lipstick, a brush, by her finger tips or some other means. At some point, perhaps immediately thereafter or later in the day, she may decide to apply a lip gloss, a moisturizer, salve, balm, unguent, emolument or other treatment to her lips over the initial lipstick. The lip covering material originally present on the lips is a material that reflects light at a wavelength in the range of about 350 to about 750 nm. In accordance with the present invention the applicator will have a rotating ball to apply the lip gloss or topical lip treatment to the consumer. The ball of the present invention will be a colored ball preferably comprised of a glass or plastic material although any suitable material including metal may be used.

The roll-on ball of the dispenser of the present invention will not become discolored or cause transferral of the original lip material to the ball in the dispenser if the ball on the dispenser of the present invention reflects light in the range of 350 to about 750 nm. More preferably, when the lip covering material reflects light at a wavelength in the range of about 400 to about 700 nm, the roll-on ball of the dispenser of the present invention will not be seen on the ball and/or will not cause transferral of the original lip material on the lips to the ball if the ball on the dispenser of the present invention reflects light in the range of 400 to about 700 nm. When the first lip material is a nonchromatic color the ball of the dispenser is preferably also a nonchromatic color. More preferably, where the nonchromatic color is a brown, the ball of the dispenser of the present invention should also be a brown. Where the nonchromatic color is a pink, the ball of the dispenser of the present invention should also preferably be a pink. Where the nonchromatic color is a magenta the ball of the dispenser of the present invention should also preferably be a magenta.

Where there is no lip material on the lips presently preferably the roll-on ball should be the color of the lip covering material in the dispenser. In a preferred embodiment of the present invention for chromatic colors, the color of the ball should be in generally the same region of the spectrum as the color of the first lip material that was applied to the lips prior to the application of the lip gloss or other topical lip treatment. When this occurs any transferral of the original lip material is masked by the color of the ball. This is demonstrated by the following prophetic examples:

EXAMPLE 1

A lipstick is applied to the lips of a consumer. This lipstick has a color that reflects light at a wave length of about 600 to about 700 nm. If the color of the ball on an applicator is selected so that it also reflects light at a wave length in the range of about 600 to about 700 nm any transferal of the original lipstick material will be masked by the color of the ball.

EXAMPLE 2

A lipstick is applied to the lips of a consumer. This lipstick has a color that reflects light at a wave length of about 600 to about 700 nm. If the color of the ball on an applicator is selected so that it absorbs light at a wave length in the range of about 400 to about 600 nm any transferal of the original lipstick material will be masked by the color of the ball.

EXAMPLE 3

A lipstick is applied to the lips of a consumer. This lipstick has a color that reflects light at a wave length of about 580 to about 650 nm. If the color of the ball on an applicator is selected so that it reflects light at a wave length in the range of about 580 nm to about 650 nm any transferal of the original lipstick material will be masked by the color of the ball.

EXAMPLE 4

A lipstick is applied to the lips of a consumer. This lipstick has a color that reflects light at a wave length of about 580 to 650 nm. If the color of the ball on an applicator is selected so that it absorbs light at a wave length in the range of about 400 to about 580 nm and 650 nm to 700 nm, any transferal of the original lipstick material will be masked by the color of the ball.

EXAMPLE 5

A lipstick is applied to the lips of a consumer. This lipstick has a color that reflects light at a wave length of about 550 to 600 nm. If the color of the ball on an applicator is selected so that it reflects light at a wave length in the range of about 550 nm to about 600 nm any transferal of the original lipstick material will be masked by the color of the ball.

EXAMPLE 6

A lipstick is applied to the lips of a consumer. This lipstick has a color that reflects light at a wave length of about 550 to 600 nm. If the color of the ball on an applicator is selected so that it absorbs light at a wave length in the range of about 400 to about 550 nm and 600 nm to 700 nm, any transferal of the original lipstick material will be masked by the color of the ball.

EXAMPLE 7

A lipstick is applied to the lips of a consumer. This lipstick has a color that reflects light at a wave length of about 500 to 580 nm. If the color of the ball on an applicator is selected so that it reflects light at a wave length in the range of about 500 nm to about 580 nm any transferal of the original lipstick material will be masked by the color of the ball.

EXAMPLE 8

A lipstick is applied to the lips of a consumer. This lipstick has a color that reflects light at a wave length of about 500 to 580 nm. If the color of the ball on an applicator is selected so that it absorbs light at a wave length in the range of about 400 to about 500 nm and 580 nm to 700 nm, any transferal of the original lipstick material will be masked by the color of the ball.

EXAMPLE 9

A lipstick is applied to the lips of a consumer. This lipstick has a color that reflects light at a wave length of about 450 to 550 nm. If the color of the ball on an applicator is selected so that it reflects light at a wave length in the range of about 450 nm to about 550 nm any transferal of the original lipstick material will be masked by the color of the ball.

EXAMPLE 10

A lipstick is applied to the lips of a consumer. This lipstick has a color that reflects light at a wave length of about 450 to 550 nm. If the color of the ball on an applicator is selected so that it absorbs light at a wave length in the range of about 400 to about 450 nm and 550 nm to 700 nm, any transferal of the original lipstick material will be masked by the color of the ball.

EXAMPLE 11

A lipstick is applied to the lips of a consumer. This lipstick has a color that reflects light at a wave length of about 400 to 500 nm. If the color of the ball on an applicator is selected so that it reflects light at a wave length in the range of about 400 nm to about 500 nm any transferal of the original lipstick material will be masked by the color of the ball.

EXAMPLE 12

A lipstick is applied to the lips of a consumer. This lipstick has a color that reflects light at a wave length of about 400 to 500 nm. If the color of the ball on an applicator is selected so that it absorbs light at a wave length in the range of about 500 nm to 700 nm, any transferal of the original lipstick material will be masked by the color of the ball.

EXAMPLE 13

A lipstick is applied to the lips of a consumer. This lipstick has a color that reflects light at a wave length of about 650 to about 700 nm. If the color of the ball on an applicator is selected so that it also reflects light at a wave length in the range of about 650 to about 700 nm any transferal of the original lipstick material will be masked by the color of the ball.

EXAMPLE 14

A lipstick is applied to the lips of a consumer. This lipstick has a color that reflects light at a wave length of about 650 to about 700 nm. If the color of the ball on an applicator is selected so that it absorbs light at a wave length in the range of about 400 to about 650 nm any transferal of the original lipstick material will be masked by the color of the ball.

EXAMPLE 15

A lipstick is applied to the lips of a consumer. This lipstick has a color that reflects light at a wave length of about 600 to about 650 nm. If the color of the ball on an applicator is selected so that it reflects light at a wave length in the range of about 600 nm to about 650 nm any transferal of the original lipstick material will be masked by the color of the ball.

EXAMPLE 16

A lipstick is applied to the lips of a consumer. This lipstick has a color that reflects light at a wave length of about 600 to 650 nm. If the color of the ball on an applicator is selected so that it absorbs light at a wave length in the range of about 400 to about 600 nm and 650 nm to 700 nm, any transferal of the original lipstick material will be masked by the color of the ball.

EXAMPLE 17

A lipstick is applied to the lips of a consumer. This lipstick has a color that reflects light at a wave length of about 500 to 600 nm. If the color of the ball on an applicator is selected so that it reflects light at a wave length in the range of about 500 nm to about 600 nm any transferal of the original lipstick material will be masked by the color of the ball.

EXAMPLE 18

A lipstick is applied to the lips of a consumer. This lipstick has a color that reflects light at a wave length of about 500 to 600 nm. If the color of the ball on an applicator is selected so that it absorbs light at a wave length in the range of about 400 to about 500 nm and 600 nm to 700 nm, any transferal of the original lipstick material will be masked by the color of the ball.

EXAMPLE 19

A lipstick is applied to the lips of a consumer. This lipstick has a color that reflects light at a wave length of about 500 to 550 nm. If the color of the ball on an applicator is selected so that it reflects light at a wave length in the range of about 500 nm to about 550 nm any transferal of the original lipstick material will be masked by the color of the ball.

EXAMPLE 20

A lipstick is applied to the lips of a consumer. This lipstick has a color that reflects light at a wave length of about 500 to 550 nm. If the color of the ball on an applicator is selected so that it absorbs light at a wave length in the range of about 400 to about 500 nm and 550 nm to 700 nm, any transferal of the original lipstick material will be masked by the color of the ball.

EXAMPLE 21

A lipstick is applied to the lips of a consumer. This lipstick has a color that reflects light at a wave length of about 450 to 500 nm. If the color of the ball on an applicator is selected so that it reflects light at a wave length in the range of about 450 nm to about 500 nm any transferal of the original lipstick material will be masked by the color of the ball.

EXAMPLE 22

A lipstick is applied to the lips of a consumer. This lipstick has a color that reflects light at a wave length of about 450 to 500 nm. If the color of the ball on an applicator is selected so that it absorbs light at a wave length in the range of about 400 to about 450 nm and 500 nm to 700 nm, any transferal of the original lipstick material will be masked by the color of the ball.

EXAMPLE 23

A lipstick is applied to the lips of a consumer. This lipstick has a color that reflects light at a wave length of about 400 to 450 nm. If the color of the ball on an applicator is selected so that it reflects light at a wave length in the range of about 400 nm to about 450 nm any transferal of the original lipstick material will be masked by the color of the ball.

EXAMPLE 24

A lipstick is applied to the lips of a consumer. This lipstick has a color that reflects light at a wave length of about 400 to 450 nm. If the color of the ball on an applicator is selected so that it absorbs light at a wave length in the range of about 450 nm to 700 nm, any transferal of the original lipstick material will be masked by the color of the ball.

In addition to characterizing a color by its wavelength, the color of the ball may also be characterized, in many instances, by its Pantone Number. In the present invention depending on the color of the lip covering material, the ball color may include but is not limited to any one of the following Pantone colors or combinations thereof:

Yellow C
Yellow 012 C
Orange 021 C
Warm Red C
Red 032 C
Rubine Red C
Rhodamine Red C
Purple C
Violet C
Blue 072
Reflex Blue
Process Blue C
Green C
Process yellow C
Process Black C
Process Magenta C
Process Cyan C
Hexachrome Yellow C
Hexachrome Orange C
Hexachrome Magenta C
Hexachrome Cyan C
Haxachrome Black C
Hexachrome Green C Pantone 100 C to 399 C, 429C to 433C, 430C to 433C, 437 C –440 C, 441 C to 587 C, 600 C–732 C, 801 C–814 C,
Pantone11205 C, 1215 C, 1225 C, 1235 C, 1245 C, 1255 C, 1265 C,
Pantone 1345 C, 1355 C, 1365 C, 1375 C, 1385 C, 1395 C, 1405 C
Pantone 1485 C, 1495 C, 1505 C, 1525 C, 1535 C, 1545 C, 1555 C, 1565 C, 1575 C, 1585 C, 1595 C, 1605 C, 1615 C, 1625 C, 1635 C, 1645 C, 1655 C, 1665 C, 1675 C, 1685 C, 1765 C, 1775 C, 1785 C, 1795 C, 1805 C, 1815 C, 1767 C, 1777 C, 1787 C, 1797 C, 1807 C, 1817 C, 1895 C, 1905 C, 1915 C, 1925 C, 1935 C, 1945 C, 1955 C, 2365 C, 2375 C, 2385 C, 2395 C, 2405 C, 2415 C, 2425 C, 2562 C, 2572 C, 2582 C, 2592 C, 2602 C, 2612 C, 2622 C, 2563 C, 2573 C, 2583 C, 2593 C, 2603 C, 2613 C, 2623 C, 2567 C, 2577 C, 2587 C, 2597 C, 2607 C, 2617 C, 2627 C, 2635 C 2645 C, 2655 C, 2675 C, 2685 C, 2695 C, 2705 C, 2715 C, 2725 C, 2735 C, 2745 C, 2755 C, 2765 C, 2706 C, 2716 C, 2726 C, 2736 C, 2746 C, 2756 C, 2766 C, 2707 C, 2717 C, 2727 C, 2737 C, 2747 C, 2757 C, 2767 C, 2708 C, 2718 C, 2728 C, 2738 C, 2748 C, 2758 C, 2768 C, 2905 C, 2915 C, 2925 C, 2935 C, 2945 C, 2955 C, 2965 C, 2975 C, 2985 C, 2995 C, 3005 C, 3015 C, 3025 C, 3035 C, 3105 C, 3115 C, 3125 C, 3135 C, 3145 C, 3155 C, 3165 C, 3242 C, 3252 C, 3262 C, 3272 C, 3282 C, 3292 C, 3302 C, 3245 C, 3255 C, 3265 C, 3275 C, 3285 C, 3295 C, 3305 C, 3248 C, 3258 C, 3268 C, 3278 C, 3288 C, 3298 C, 3308 C, 3935 C, 3945 C, 3955 C, 3965 C, 3975 C, 3985 C, 3995 C, 4485 C, 4495 C, 4505 C, 4515 C, 4525 C, 4535 C, 4545 C, 4625 C, 4635 C, 4645 C, 4655 C, 4665 C, 4675 C, 4685 C, 4695 C, 4705 C, 4715 C, 4725 C, 4735 C, 4745 C, 4755 C, 4975 C, 4985 C, 4995 C, 5005 C, 5015 C, 5025 C, 5035 C, 5115 C, 5125 C, 5135 C, 5145 C, 5155 C, 5165 C, 5175 C, 5185 C, 5195 C, 5205 C, 5215 C, 5225 C, 5235 C, 5245 C, 5255 C, 5265 C, 5275 C, 5285 C, 5295 C, 5305 C, 5315 C, 5395 C, 5405 C, 5415 C, 5425 C, 5435 C, 5445 C, 5455 C, 5463 C, 5473 C, 5483 C, 5493 C, 5503 C, 5513 C, 5523 C, 5467 C, 5477 C, 5487 C, 5497 C, 5507 C, 5517 C, 5527 C, 5535 C, 5545 C, 5555 C, 5565 C, 5575 C, 5585 C, 5595 C, 5743 C, 5753 C, 5763 C, 5773 C, 5783 C, 5793 C, 5803 C, 5747 C, 5757 C, 5767 C, 5777 C, 5787 C, 5797 C, 5807 C, 5815 C, 5825 C, 5835 C, 5845 C, 5855 C, 5865 C, 5875 C
Black 2C, 3C, 4C, 5C, 6C, 7C
Warm Gray 5C–11C
Yellow U
Yellow 012 U
Orange 021 U
Warm Red U
Red 032 U
Rubine Red U
Rhodamine Red U
Purple U Violet U
Blue 072 U
Reflex Blue U
Process Blue U
Green U
Process yellow U
Process Magenta U
Process Cyan U
Process Black U
Hexachrome Yellow U
Hexachrome Orange U
Hexachrome Magenta U
Hexachrome Black U
Hexachrome Cyan U
Hexachrome Green U
Pantone 100 U to 399 U, 429U to 433U, 430U to 433U, 437U to 440 U, 441 U to 587 U, 600 U –732 U, 801 U–814 U,
Pantone 1206 U, 1215 U, 1225 U, 1235 U, 1245 U, 1255U, 1265 U,
Pantone 1345 U, 1355 U, 1365 U, 1375 U, 1385 U, 1395 U, 1405 U
Pantone 1485 U, 1495 U, 1505 U, 1525 U, 1535 U, 1545 U, 1555 U, 1565 U, 1575 U, 1585 U, 1595 U, 1605 U, 1615 U, 1625 U, 1635 U, 1645 U, 1655 U, 1665 U, 1675 U, 1685 U, 1765 U, 1775 U, 1785 U, 1795 U, 1805 U, 1815 U, 1767 U, 1777 U, 1787 U, 1797 U, 1807 U, 1817 U, 1895 U, 1905 U, 1915 U, 1925 U, 1935 U, 1945 U, 1955 U, 2365 U, 2375 U, 2385 U, 2395 U, 2405 U, 2415 U, 2425 U, 2562 U, 2572 U, 2582 U, 2592 U, 2602 U, 2612 U, 2622 U, 2563 U, 2573 U, 2583 U, 2593 U, 2603 U, 2613 U, 2623 U, 2567 U, 2577 U, 2587 U, 2597 U, 2607 U, 2617 U, 2627 U, 2635 U, 2645 U, 2655 U, 2675 U, 2685 U, 2695 U, 2705 U, 2715 U, 2725 U, 2735 U, 2745 U, 2755 U, 2765 U, 2706 U, 2716 U, 2726 U, 2736 U, 2746 U, 2756 U, 2766 U, 2707 U, 2717 U, 2727 U, 2737 U, 2747 U, 2757 U, 2767 U, 2708 U, 2718 U, 2728 U, 2738 U, 2748 U, 2758 U, 2768 U, 2905 U, 2915 U, 2925 U, 2935 U, 2945 U, 2955 U, 2965 U, 2975 U, 2985 U, 2995 U, 3005 U, 3015 U, 3025 U, 3035 U, 3105 U, 3115 U, 3125 U, 3135 U, 3145 U, 3155 U, 3165U, 3242 U, 3252 U, 3262 U, 3272 U, 3282 U, 3292 U, 3302 U, 3245 U, 3255 U, 3265 U, 3275 U, 3285 U, 3295 U, 3305 U, 3248 U, 3258 U, 3268 U, 3278 U, 3288 U, 3298 U, 3308 U, 3935 U, 3945 U, 3955 U, 3965 U, 3975 U, 3985 U, 3995 U, 4485 U, 4495 U, 4505 U, 4515 U, 4525 U, 4535 U, 4545 U, 4625 U, 4635 U, 4645 U, 4655 U, 4665 U, 4675 U, 4685 U, 4695 U, 4705 U, 4715 U, 4725 U, 4735 U, 4745 U, 4755 U, 4975 U, 4985 U, 4995 U, 5005 U, 5015 U, 5025 U, 5035 U, 5115 U, 5125 U, 5135 U, 5145 U, 5155 U, 5165U, 5175 U, 5185 U, 5195 U, 5205 U, 5215 U, 5225 U, 5235 U, 5245 U, 5255 U, 5265 U, 5275 U, 5285 U, 5295 U, 5305 U, 5315 U, 5395 U, 5405 U, 5415 U, 5425 U, 5435 U, 5445 U, 5455 U, 5463 U, 5473 U, 5483 U, 5493 U, 5503 U, 5513 U, 5523 U, 5467 U, 5477 U, 5487 U, 5497 U, 5507 U, 5517 U, 5527 U, 5535 U, 5545 U, 5555 U, 5565 U, 5575 U, 5585 U, 5595 U, 5743 U, 5753 U, 5763 U, 5773 U, 5783 U, 5793 U, 5803 U, 5747 U, 5757 U, 5767 U, 5777 U, 5787 U, 5797 U, 5807 U, 5815 U, 5825 U, 5835 U, 5845 U, 5855 U, 5865 U, 5875 U
Black 2U, 3U, 4U, 5U, 6U, 7U, and
Warm Gray 5U–11U.

We claim:

1. A container comprising a lip treatment material, said lip treatment material having a chromatic or nonchromatic color, said container having a base, an outer surface, an inner surface and a top surface said top surface having at least one orifice therein, said container having a rotatable ball mounted at said orifice for applying the lip treatment material from the container to the lips of the user, said rotatable ball having a color selected from the group consisting of chromatic and nonchromatic colors that is similar to said color of said lip treatment material so as to prevent soiled appearance on said ball.

2. The container according to claim 1 wherein the lip treatment material is a nonchromatic color and the ball is a nonchromatic color.

3. The container according to claim 2 wherein the nonchromatic color is a magenta.

4. The container according to claim 3 wherein the lip treatment material and said ball are comprised of a chromatic color that has a wavelength in the range about 400 to about 700 nm.

5. The container according to claim 4 wherein the lip treatment material and said ball are comprised of a chromatic color that has a wavelength in the range about 400 to about 600 nm.

6. The container according to claim 4 wherein the lip treatment material and said ball are comprised of a chromatic color that has a wavelength in the range about 500 to about 700 nm.

7. The container according to claim 4 wherein the lip treatment material and said ball are comprised of a chromatic color that has a wavelength in the range about 450 to about 650 nm.

8. The container according to claim 4 wherein the lip treatment material and said ball are comprised of a chromatic color that has a wavelength in the range about 400 to about 500 nm.

9. The container according to claim 4 wherein the lip treatment material and said ball are comprised of a chromatic color that has a wavelength in the range about 450 to about 550 nm.

10. The container according to claim 4 wherein the lip treatment material and said ball are comprised of a chromatic color that has a wavelength in the range about 500 to about 600 nm.

11. The container according to claim 4 wherein the lip treatment material and said ball are comprised of a chromatic color that has a wavelength in the range about 550 to about 650 nm.

12. The container according to claim 4 wherein the lip treatment material and said ball are comprised of a chromatic color that has a wavelength in the range about 600 to about 700 nm.

13. The container according to claim 4 wherein the lip treatment material and said ball are comprised of a chromatic color that has a wavelength in the range about 400 to about 450 nm.

14. The container according to claim 4 wherein the lip treatment material and said ball are comprised of a chromatic color that has a wavelength in the range about 450 to about 500 nm.

15. The container according to claim 4 wherein the lip treatment material and said ball are comprised of a chromatic color that has a wavelength in the range about 500 to about 550 nm.

16. The container according to claim 4 wherein the lip treatment material and said ball are comprised of a chromatic color that has a wavelength in the range about 550 to about 600 nm.

17. The container according to claim 4 wherein the lip treatment material and said ball are comprised of a chromatic color that has a wavelength in the range about 600 to about 650 nm.

18. The container according to claim 4 wherein the lip treatment material and said ball are comprised of a chromatic color that has a wavelength in the range about 650 to about 700 nm.

19. The container according to claim 4 wherein the lip treatment material and said ball are comprised of a chromatic color that has a wavelength in the range about 580 to about 650 nm.

20. The container according to claim 4 wherein the lip treatment material and said ball are comprised of a chromatic color that has a wavelength in the range about 500 to about 580 nm.

21. The container according to claim 2 wherein the nonchromatic color is a pink.

22. The container according to claim 2 wherein the nonchromatic color is a brown.

23. The container according to claim 1 wherein the first lip treatment material is a chromatic color and the ball is a chromatic color.

24. The container according to claim 23 wherein the lip treatment material and said ball are comprised of a chromatic color that has a wavelength in the range about 350 to about 750 nm.

25. A container comprising a lip treatment material, said lip treatment material having a Pantone color, said container having a base, an outer surface, an inner surface and a top surface said top surface having at least one orifice therein, said container having a rotatable ball mounted at said orifice for applying the lip treatment material from the container to the lips of the user, said rotatable ball having a Pantone color that is similar to said color of said lip treatment material selected from the group consisting of colors identified with the Pantone designation or combinations as follow so as to prevent soiled appearance on said ball;

Yellow C,
Yellow 012 C,
Orange 021 C,
Warm Red C,
Red 032 C,
Rubine Red C,
Rhodamine Red C,
Purple C,
Violet C,
Blue 072,
Reflex Blue,
Process Blue C,
Green C,
Process yellow C,
Process Black C,
Process Magenta C,
Process Cyan C,
Hexachrome Yellow C,
Hexachrome Orange C,
Hexachrome Magenta C,
Hexachrome Cyan C,
Haxachrome Black C,
Hexachrome Green C,
Pantone 100 C to 399 C, 429C to 433C, 430C to 433C, 437 C to 440 C, 441 C to 587 C, 600 C to 732 C, 801 C to 814 C,
Pantone 1205 C, 1215 C, 1225 C, 1235 C, 1245 C, 1255 C, 1265 C,
Pantone 1345 C, 1355 C, 1365 C, 1375 C, 1385 C, 1395 C, 1405 C,
Pantone 1485 C, 1495 C, 1505 C, 1525 C, 1535 C, 1545 C, 1555 C, 1565 C, 1575 C, 1585 C, 1595 C, 1605 C, 1615 C, 1625 C, 1635 C, 1645 C, 1655 C, 1665 C, 1675 C, 1685 C, 1765 C, 1775 C, 1785 C, 1795 C, 1805 C, 1815 C, 1767 C, 1777 C, 1787 C, 1797 C, 1807 C, 1817 C, 1895 C, 1905 C, 1915 C, 1925 C, 1935 C, 1945 C, 1955 C, 2365 C, 2375 C, 2385 C, 2395 C, 2405 C, 2415 C, 2425 C, 2562 C, 2572 C, 2582 C, 2592 C, 2602 C, 2612 C, 2622 C, 2563 C, 2573 C, 2583 C, 2593 C, 2603 C, 2613 C, 2623 C, 2567 C, 2577 C, 2587 C, 2597 C, 2607 C, 2617 C, 2627 C, 2635 C, 2645 C, 2655 C, 2675 C, 2685 C, 2695 C, 2705 C, 2715 C, 2725 C, 2735 C, 2745 C, 2755 C, 2765 C, 2706 C, 2716 C, 2726 C, 2736 C, 2746 C, 2756 C, 2766 C, 2707 C, 2717 C, 2727 C, 2737 C, 2747 C, 2757 C, 2767 C, 2708 C, 2718 C, 2728 C, 2738 C, 2748 C, 2758 C, 2768 C, 2905 C, 2915 C, 2925 C, 2935 C, 2945 C, 2955 C, 2965 C, 2975 C, 2985 C, 2995 C, 3005 C, 3015 C, 3025 C, 3035 C, 3105 C, 3115 C, 3125 C, 3135 C, 3145 C, 3155 C, 3165C, 3242 C, 3252 C, 3262 C, 3272 C, 3282 C, 3292 C, 3302 C, 3245 C, 3255 C, 3265 C, 3275 C, 3285 C, 3295 C, 3305 C, 3248 C, 3258 C, 3268 C, 3278 C, 3288 C, 3298 C, 3308 C, 3935 C, 3945 C, 3955 C, 3965 C, 3975 C, 3985 C, 3995 C, 4485 C, 4495 C, 4505 C, 4515 C, 4525 C, 4535 C, 4545 C, 4625 C, 4635 C, 4645 C, 4655 C, 4665 C, 4675 C, 4685 C, 4695 C, 4705 C, 4715 C, 4725 C, 4735 C, 4745 C, 4755 C, 4975 C, 4985 C, 4995 C, 5005 C, 5015 C, 5025 C, 5035 C, 5115 C, 5125 C, 5135 C, 5145 C, 5155 C, 5165C, 5175 C, 5185 C, 5195 C, 5205 C, 5215 C, 5225 C, 5235 C, 5245 C, 5255 C, 5265 C, 5275 C, 5285 C, 5295 C, 5305 C, 5315 C, 5395 C, 5405 C, 5415 C, 5425 C, 5435 C, 5445 C, 5455 C, 5463 C, 5473 C, 5483 C, 5493 C, 5503 C, 5513 C, 5523 C, 5467 C, 5477 C, 5487 C, 5497 C, 5507 C, 5517 C, 5527 C, 5535 C, 5545 C, 5555 C, 5565 C, 5575 C, 5585 C, 5595 C, 5743 C, 5753 C, 5763 C, 5773 C, 5783 C, 5793 C, 5803 C, 5747 C, 5757 C, 5767 C, 5777 C, 5787 C, 5797 C, 5807 C, 5815 C, 5825 C, 5835 C, 5845 C, 5855 C, 5865 C, 5875 C,
Black 2C, 3C, 4C, 5C, 6C, 7C,
Warm Gray 5C to 11C,
Yellow U,
Yellow 012 U,
Orange 021 U,
Warm Red U,
Red 032 U,
Rubine Red U,
Rhodamine Red U,
Purple U,
Violet U,
Blue 072 U,
Reflex Blue U,
Process Blue U,
Green U,
Process yellow U,
Process Magenta U,
Process Cyan U,
Process Black U,
Hexachrome Yellow U,
Hexachrome Orange U,
Hexachrome Magenta U,
Hexachrome Black U,
Hexachrome Cyan U,
Hexachrome Green U,
Pantone 100 U to 399 U, 429U to 433U, 430U to 433U, 437 U to 440U, 441 U to 587 U, 600 U to 732 U, 801 U to 814 U,
Pantone 1205 U, 1215 U, 1225 U, 1235 U, 1245 U, 1255U, 1265 U, Pantone 1345 U, 1355 U, 1365 U, 1375 U, 1385 U, 1395 U, 1405 U, Pantone 1485 U, 1495 U, 1505 U, 1525 U, 1535 U, 1545 U, 1555 U, 1565 U, 1575 U, 1585 U 1595 U, 1605 U, 1615 U, 1625 U, 1635 U, 1645 U, 1655 U, 1665 U, 1675 U, 1685 U, 1765 U, 1775 U, 1785 U, 1795 U, 1805 U, 1815 U, 1767 U, 1777 U, 1787 U, 1797 U, 1807 U, 1817 U, 1895 U, 1905 U, 1915 U, 1925 U, 1935 U, 1945 U, 1955 U, 2365 U, 2375 U, 2385 U, 2395 U, 2405 U, 2415 U, 2425 U, 2562 U, 2572 U, 2582 U, 2592 U, 2602 U, 2612 U, 2622 U, 2563 U, 2573 U, 2583 U, 2593 U, 2603 U, 2613 U, 2623 U, 2567 U, 2577 U, 2587 U, 2597 U, 2607 U, 2617 U, 2627 U, 2635 U, 2645 U, 2655 U, 2675 U, 2685 U, 2695 U, 2705 U, 2715 U, 2725 U, 2735 U, 2745 U, 2755 U, 2765 U, 2706 U, 2716 U, 2726 U, 2736 U, 2746 U, 2756 U, 2766 U, 2707 U, 2717 U, 2727 U, 2737 U, 2747 U, 2757 U, 2767 U, 2708 U, 2718 U, 2728 U, 2738 U, 2748 U, 2758 U, 2768 U, 2905 U, 2915 U, 2925 U, 2935 U, 2945 U, 2955 U, 2965 U, 2975 U, 2985 U, 2995 U, 3005 U, 3015 U, 3025 U, 3035 U, 3105 U, 3115 U, 3125 U, 3135 U, 3145 U, 3155 U, 3165U, 3242 U, 3252 U, 3262 U, 3272 U, 3282 U, 3292 U, 3302 U, 3245 U, 3255 U, 3265 U, 3275 U, 3285 U, 3295 U, 3305 U, 3248 U, 3258 U, 3268 U, 3278 U, 3288 U, 3298 U, 3308 U, 3935 U, 3945 U, 3955 U, 3965 U, 3975 U, 3985 U, 3995 U, 4485 U, 4495 U, 4505 U, 4515 U, 4525 U, 4535 U, 4545 U, 4625 U, 4635 U, 4645 U, 4655 U, 4665 U, 4675 U, 4685 U, 4695 U, 4705 U, 4715 U, 4725 U, 4735 U, 4745 U, 4755 U, 4975 U, 4985 U, 4995 U, 5005 U, 5015 U, 5025 U, 5035 U, 5115 U, 5125 U, 5135 U, 5145 U, 5155 U, 5165U, 5175 U, 5185 U, 5195 U, 5205 U, 5215 U, 5225 U, 5235 U, 5245 U, 5255 U, 5265 U, 5275 U, 5285 U, 5295 U, 5305 U, 5315 U, 5395 U, 5405 U, 5415 U, 5425 U, 5435 U, 5445 U, 5455 U, 5463 U, 5473 U, 5483 U, 5493 U, 5503 U, 5513 U, 5523 U, 5467 U, 5477 U, 5487 U, 5497 U, 5507 U, 5517 U, 5527 U, 5535 U, 5545 U, 5555 U, 5565 U, 5575 U, 5585 U, 5595 U, 5743 U, 5753 U, 5763 U, 5773 U, 5783 U, 5793 U, 5803 U, 5747 U, 5757 U, 5767 U, 5777 U, 5787 U, 5797 U, 5807 U, 5815 U, 5825 U, 5835 U, 5845 U, 5855 U, 5865 U, 5875 U, Black 2U, 3U, 4U, 5U, 6U, 7U, and Warm Gray 5U to 11U.

* * * * *